US006966296B2

(12) United States Patent
Miyazaki et al.

(10) Patent No.: US 6,966,296 B2
(45) Date of Patent: Nov. 22, 2005

(54) THROTTLE DEVICE

(75) Inventors: Shinsuke Miyazaki, Obu (JP); Katsuya Torii, Anjo (JP); Hidetoshi Uchiyama, Tokai (JP)

(73) Assignee: Denso Corporation, (JP)

( * ) Notice: Subject to any disclaimer, the term of this patent is extended or adjusted under 35 U.S.C. 154(b) by 183 days.

(21) Appl. No.: 10/606,369

(22) Filed: Jun. 26, 2003

(65) Prior Publication Data

US 2005/0072403 A1 Apr. 7, 2005

(30) Foreign Application Priority Data

Jun. 27, 2002 (JP) ..... 2002-187331

(51) Int. Cl.[7] ..... F02D 9/10; F02D 11/10
(52) U.S. Cl. ..... 123/399
(58) Field of Search ..... 123/399

(56) References Cited

U.S. PATENT DOCUMENTS 3,897,178 A * 7/1975 Palloch ..... 417/368
3,919,574 A * 11/1975 Schmuck ..... 310/68 R
5,141,070 A 8/1992 Hickmann et al.
5,358,341 A * 10/1994 Blaettner et al. ..... 384/204
5,912,538 A 6/1999 Turner
6,390,062 B1 * 5/2002 Saito et al. ..... 123/399
6,417,595 B1 * 7/2002 Wasson ..... 310/220
6,581,569 B2 * 6/2003 Arsic et al. ..... 123/399
6,586,855 B2 * 7/2003 Burger et al. ..... 310/88
2004/0079331 A1 * 4/2004 Kaiser et al. ..... 123/399

FOREIGN PATENT DOCUMENTS

EP 1099840 A2 5/2001
JP 1-308155 12/1989
JP 5-9174 2/1993
JP 2001-037145 2/2001
JP 2001-241336 9/2001

* cited by examiner

*Primary Examiner*—Henry C. Yuen
*Assistant Examiner*—Arnold Castro
(74) *Attorney, Agent, or Firm*—Nixon & Vanderhye PC

(57) ABSTRACT

A throttle device which prevents the entry of foreign compounds into a slidable contact portion between a brush and a commutator is provided to prevent the malfunctioning of a motor. A first shielding portion is integrally formed in a brush holder, which is attached to a yoke of a motor for holding a brush. The plate-shaped first shielding portion covers the vicinity of the yoke in the outer periphery of the yoke. Accordingly, the first shielding portion covers a gap left between the yoke and the brush holder, and a slidable contact portion between a commutator and the brush on a throttle gear side. Therefore, the first shielding portion prevents a foreign compound, generated in an engagement portion between the throttle gear and a reduction gear and falling onto a motor, from moving to the slidable contact portion, so that it is possible to prevent poor contact between the commutator and the brush.

17 Claims, 6 Drawing Sheets

THROTTLE DEVICE

CROSS REFERENCE TO RELATED APPLICATION

This application is based upon, claims the benefit of priority of, and incorporates by reference, the contents of Japanese Patent Application No. 2002-187331 filed Jun. 27, 2002.

BACKGROUND OF THE INVENTION

1. Field of the Invention

The present invention relates to a throttle device which controls the intake air drawn into an internal combustion engine, hereinafter called "engine."

2. Description of the Related Art

In recent years, a so-called electronic throttle device in which a motor drives a valve member (15) for controlling an amount of intake airflow is adopted as a throttle device for an engine of a vehicle. Japanese Patent Laid-Open Publication No. Hei 13-241336, for example, discloses an electronic throttle device like this. In the electronic throttle device disclosed therein, a driving force transmission means having a plurality of gears transmits torque generated by a motor to a valve member.

In a case where the gears transmit the torque of the motor, however, a foreign compound such as an abrasion powder is generated in the engagement portion of the gears, for example. The above throttle valve device (the throttle device), disclosed in Japanese Patent Laid-Open Publication No. Hei 13-241336, prevents the generated foreign compound from getting into the vicinity of a return spring which biases the valve member toward an opposite direction of the drive direction of the motor, for the purpose of stably controlling the valve member.

On the other hand, as described above, the motor for driving the valve member is absolutely necessary in the electronic throttle device. The motor generally has a brush and a commutator which are in slidable contact with each other. Generally, the motor is disposed in the lower portion of the throttle device, and the plurality of gears as the driving force transmission means are disposed above the motor. Accordingly, the abrasion powder generated in the engagement portion of the gears and the like falls onto the motor, so that the foreign compound tends to get into and contaminate a slidable contact portion between the brush and the commutator of the motor. The entry of the foreign compound into the slidable contact portion causes the malfunction of the motor, due to poor slidable contact between the brush and the commutator.

SUMMARY OF THE INVENTION

In view of the foregoing problems, an object of the present invention is to provide a throttle device which prevents a foreign compound from getting into a slidable contact portion between a brush and a commutator, in order to prevent malfunctioning of a motor.

According to a first aspect of the present invention, a throttle device is provided with a shielding means. The shielding means is provided on a slidable contact portion on a side facing a driving force transmission means. A brush and a commutator are slidably in contact with each other in the slidable contact portion. The shielding means prevents the movement of a foreign compound, generated in the engagement portion of the gears in the driving force transmission means, into the slidable contact portion thereby preventing poor contact in the slidable contact portion. Therefore, motor malfunctioning is prevented.

In a throttle device according to another aspect of the present invention, the shielding means has a first shielding portion. The first shielding portion is provided in a brush holder, and shields the slidable contact portion from the outside of the motor. Accordingly, it is possible to prevent the foreign compound, generated in a driving force transmission portion, from moving and getting into the slidable contact portion. Therefore, motor malfunctioning is prevented.

In a throttle device according to still another aspect of the present invention, the shielding means has a second shielding portion. The second shielding portion is provided in the brush holder, and shields the slidable contact portion from the inside of the motor. Accordingly, it is possible to prevent the foreign compound, generated in a driving force transmission portion, from moving and getting into the slidable contact portion. Therefore, motor malfunctioning is prevented.

In a throttle device according to another aspect of the present invention, the shielding means has a tape member. The tape member is stuck on the motor, and covers the brush holder. Accordingly, it is possible to prevent the foreign compound, generated in a driving force transmission portion, from moving and getting into the slidable contact portion, for example, from the vicinity of the brush holder. Therefore, malfunctioning of the motor is prevented.

In a throttle device according to still another aspect of the present invention, the shielding means has a third shielding portion. The third shielding portion is disposed between the engagement portion of the gears of the driving force transmission means and the motor. Accordingly, it is possible to prevent the foreign compound, generated in a driving force transmission portion, from moving and getting into the slidable contact portion. Therefore, motor malfunctioning is prevented.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments, with reference to the accompanying drawings, is merely exemplary in nature and is in no way intended to limit the invention, its application, or uses.

(First Embodiment)

Figure 1:
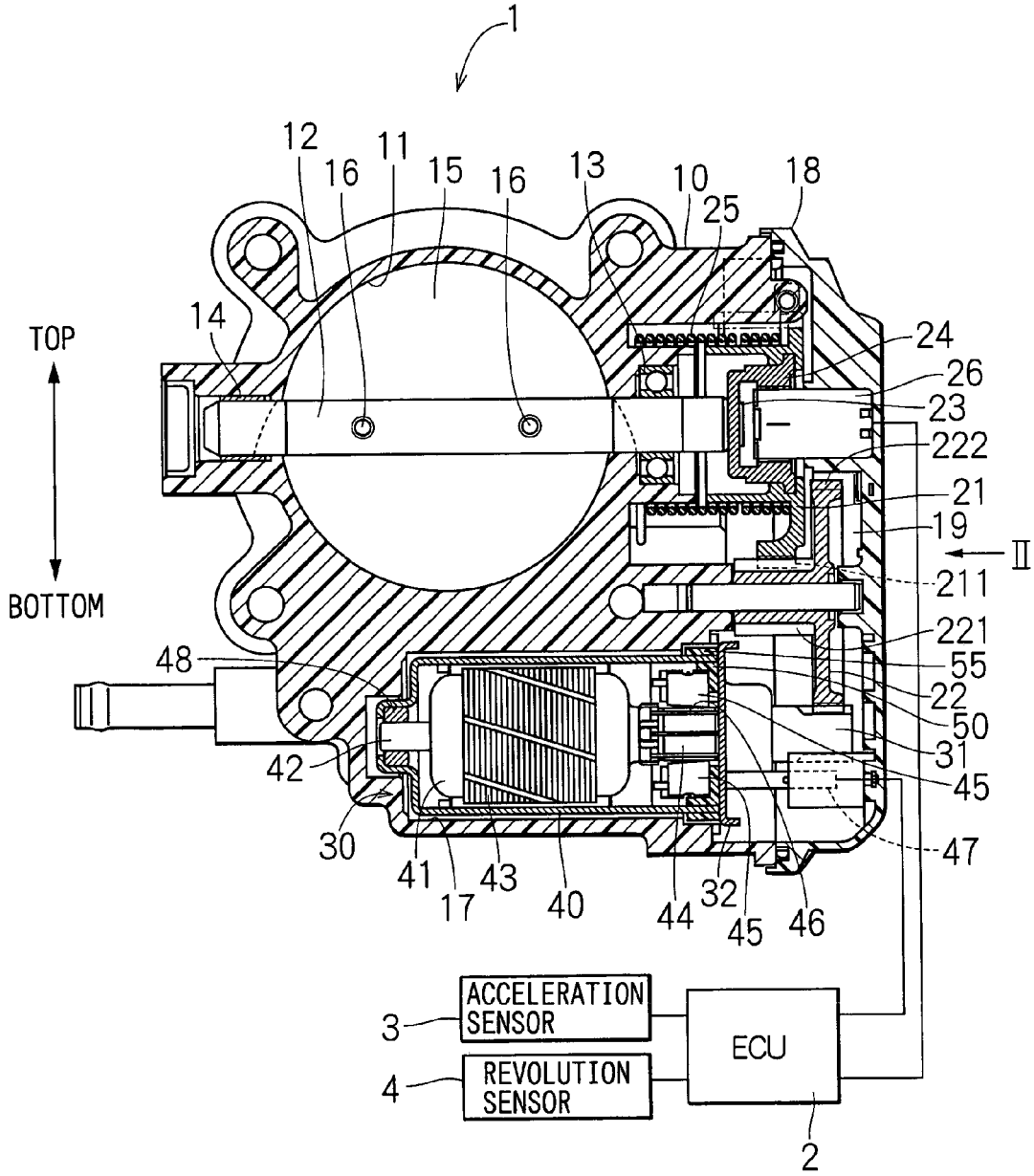
FIG. 1 is a schematic cross-sectional view of a throttle device according to a first embodiment of the present invention.
Figure 2:
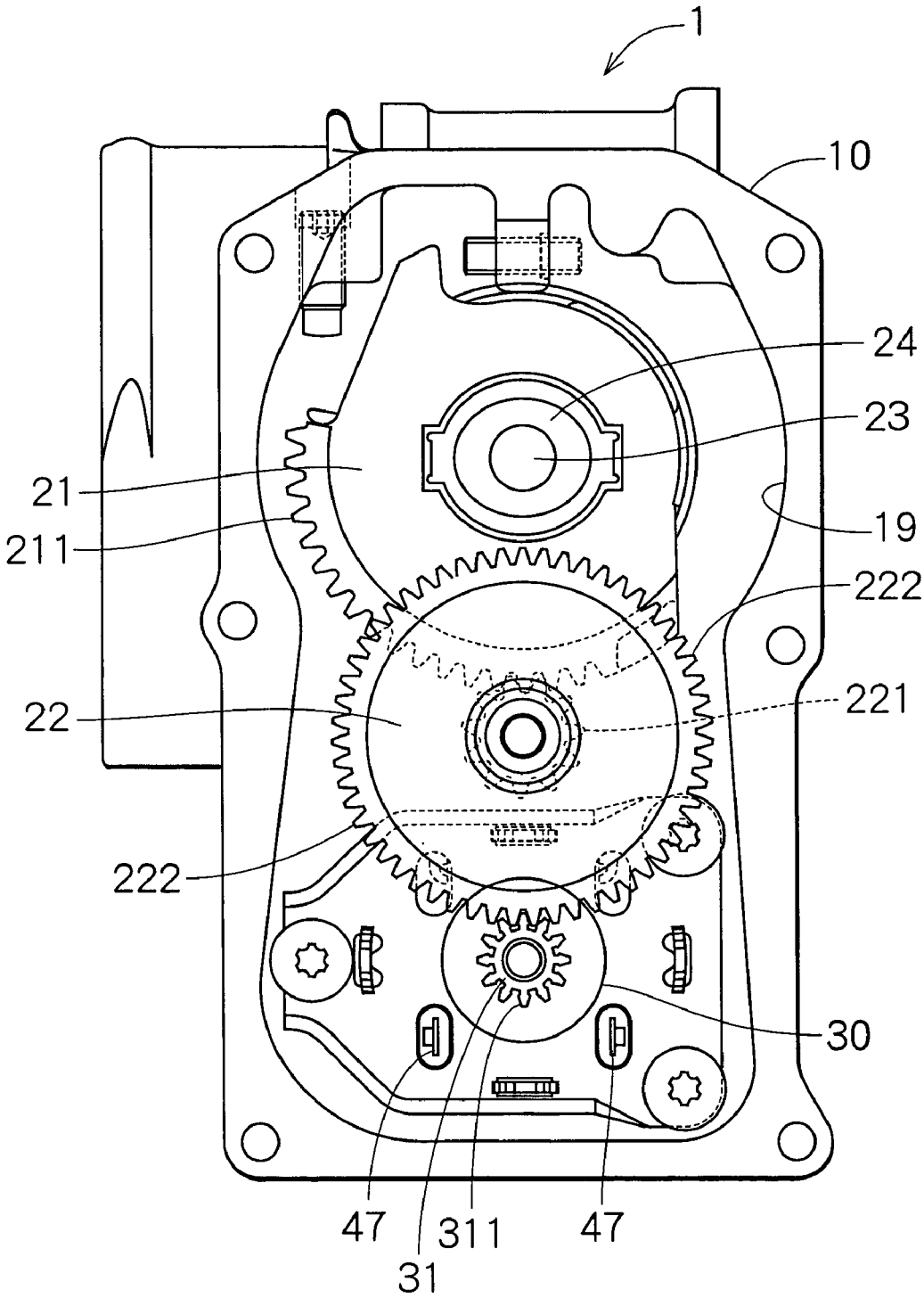
FIG. 2 is a side view of the throttle device viewed from the direction of arrow II of FIG. 1 according to the first embodiment.

FIGS. 1 and 2 show a throttle device according to a first embodiment of the present invention. A throttle device 1 electrically controls the degree of opening of a throttle in accordance with a driving condition of an engine, such as the degree of depression or opening of an accelerator, the rpm (revolutions per minute) of the engine, the load of the engine, the temperature of the cooling water, and the like, for the purpose of adjusting an amount of intake airflow flowing in an intake air path 11 formed in a throttle body 10. FIG. 1 shows the fully open condition of the throttle device 1.

The throttle body 10 holds a throttle shaft 12 via a bearing 13 and a bearing portion 14 provided on both ends of the throttle shaft 12 so that the shaft 12 can freely rotate. A disc-shaped valve member 15 is secured to the throttle shaft 12 with screws 16. Thus, the throttle shaft 12 and the valve member 15 integrally rotate.

A driving force transmission means is composed of a throttle gear 21 and a reduction gear 22. The throttle gear 21 formed in the shape of a half disc is secured to the throttle shaft 12 with a bolt 23 so as not to be able to rotate relative to the throttle shaft 12. A locking member 24 attached to the throttle gear 21 rotates together with the throttle gear 21. There is a spring 25 with one end secured to the throttle body 10, and the other end secured to the locking member 24.

The spring 25 biases the throttle gear 21 and the locking member 24, integrally with the throttle gear 21, toward the closing direction of the valve member 15. In a fully closed position, the locking member 24 is so engaged with a full close stopper (not illustrated) provided in the throttle body 10, that the rotation in the valve closing direction is regulated. The position of the full close stopper corresponds to the fully closed position of the opening degree of the throttle.

The reduction gear 22 has a small diameter gear wheel 221 and a large diameter gear wheel 222. The small diameter gear wheel 221 is engaged with the gear wheel 211 of the throttle gear 21. The large diameter gear wheel 222 is engaged with the gear wheel 311 of a motor gear 31 of a motor 30.

The motor 30 is housed in the motor chamber 17 of the throttle body 10. The torque generated in the motor 30 is transmitted to the throttle shaft 12 and the valve member 15 via the reduction gear 22 and the throttle gear 21. A cover 18 covering the throttle gear 21, reduction gear 22, and the motor 30, which constitute the driving force transmission means, forms a gear container 19, also known as a gear housing chamber 19, with the throttle body 10. The gear housing chamber 19 as a transmission means housing, houses each gear. The throttle device 1 is installed in an engine in a vertical direction as shown in FIG. 1, so that the motor 30 is positioned below the engagement portion of the throttle gear 21 and the reduction gear 22 in a normal installation position (in the direction of gravity).

A rotation angle sensor 26, attached to the end of the throttle shaft 12 on a throttle gear 21 side, detects the degree of throttle opening. The degree of throttle opening detected by the rotation angle sensor 26 is output to an engine control unit (ECU) 2. The ECU 2 controls an amount of electric current applied to the motor 30, on the basis of the degree of acceleration opening detected by an acceleration sensor 3, the rpm of the engine detected by an rpm sensor 4, various signals detected by other various sensors, and the detection signals of the degree of throttle opening output from the rotation angle sensor 26, in order to adjust the degree of throttle opening. The driving force of the motor 30 acts on the throttle gear 21 in an opposite direction to the biasing force of the spring 25, namely in the valve closing direction.

Details of the motor 30 will now be described. The motor 30 being a DC motor has a yoke 40 containing a rotor 41. The rotor 41 comprises a shaft 42 and a coil 43 disposed around the shaft 42. One end of the coil 43 is connected to a commutator 44. The yoke 40 houses a brush 45 which can slide against the contact with the commutator 44 in a slidable contact portion 46. The brush 45 is connected to a terminal 47 to which the ECU 2 applies electric current. The end of the shaft 42 is held by a bearing 48. A motor gear 31 is attached to the other end of the shaft 42, namely the end opposite to the bearing 48. The motor gear 31 is attached to the shaft 42 with a press fit, for example.

Figure 3A:
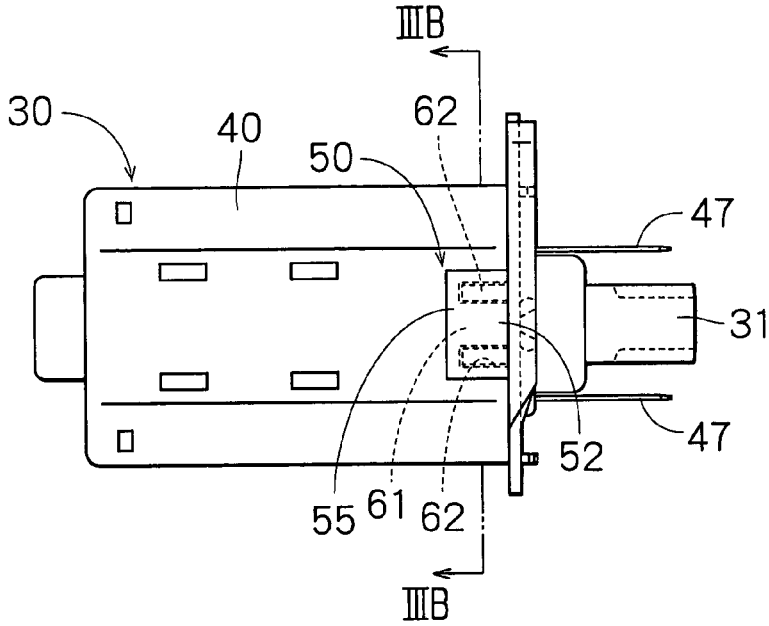
FIG. 3A is a schematic view of the motor viewed from a throttle gear side according to the first embodiment.
Figure 3B:
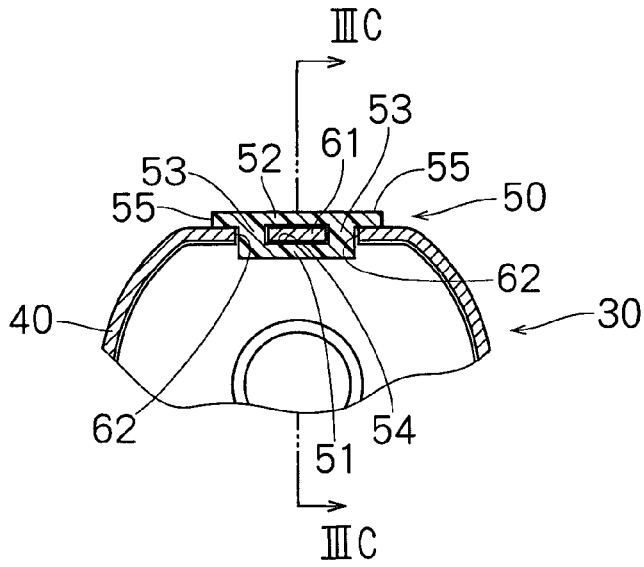
FIG. 3B is a cross-sectional view taken along the line IIIB—IIIB in FIG. 3A according to the first embodiment.
Figure 3C:
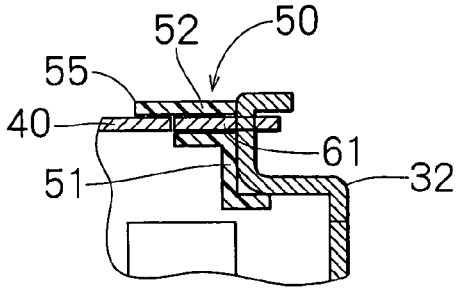
FIG. 3C is a cross-sectional view taken along the line IIIC—IIIC in FIG. 3B according to the first embodiment.

The brush 45 is held by a brush holder 50, and is attached to the yoke 40 via the holder 50. The brush holder 50 is attached to the yoke 40 as shown in FIGS. 3A–3C. The brush holder 50 has a base portion 51 provided on the inner periphery of the yoke 40, a protruding portion 52 protruding to the outer periphery side of the yoke 40, an arm portion 53 connecting the base portion 51 to the protruding portion 52, and a hole 54 defined by the base portion 51, the protruding portion 52, and the arm portion 53. The brush 45 is attached on the base portion 51. The yoke 40 has a flake-like tab portion 61 and a groove 62 formed in one end of the yoke 40 on a cap 32 side. When the brush holder 50 is fitted into the yoke 40, the tab portion 61 is inserted into the hole 54, and the arm portion 53 is inserted into the groove 62. A cap 32 is fitted under the condition that the brush holder 50 is fitted into the yoke 40, so that the brush holder 50 is held between the yoke 40 and the cap 32. The groove 62 is formed slightly larger than the arm portion 53 of the brush holder 50 in order to improve the ease of attachment. Accordingly, a narrow gap is left between the groove 62 and the arm portion 53.

In the brush holder 50, a first shield portion 55 is formed integrally with the protruding portion 52. The plate-shaped first shield portion 55 covers a part of the outer periphery of the yoke 40 on the throttle gear 21 side of the slidable contact portion 46, between the commutator 44 and the brush 45. The first shielding portion 55 extends to a circumferential direction and an axial direction of the yoke 40 from the edge of the protruding portion 52. Thus, as shown in FIGS. 3B and 3C, besides the groove 62 formed in the yoke 40, the gap left between the groove 62 and the arm portion 53 is covered with the first shield portion 55. Covering the groove 62 and the gap around it with the first shielding portion 55 creates a space between the yoke 40 and the brush holder 50 a complex shape, such as a labyrinth. The side of the slidable contact portion 46 facing the throttle gear 21 is shielded by the first shielding portion 55, which is integral with the brush holder 50, on the outside of the yoke 40.

In the throttle device 1 according to the first embodiment, as described above, the first shielding portion 55 for covering the slidable contact portion 46 at the outside of the yoke 40 is formed in the brush holder 50. Therefore, the foreign compound, generated in the engagement portion of the throttle gear 21 and the reduction gear 22, which falls onto the motor 30, does not move in a direction of the slidable contact portion 46 due to the first shielding portion 55. The foreign compound is prevented from getting into the slidable contact portion 46 between the commutator 44 and the brush 45. Accordingly, it is possible to prevent the malfunction of the motor 30 because of poor contact between the commutator 44 and the brush 45 is prevented.

(Second, Third, and Fourth Embodiments)

Figure 4A:
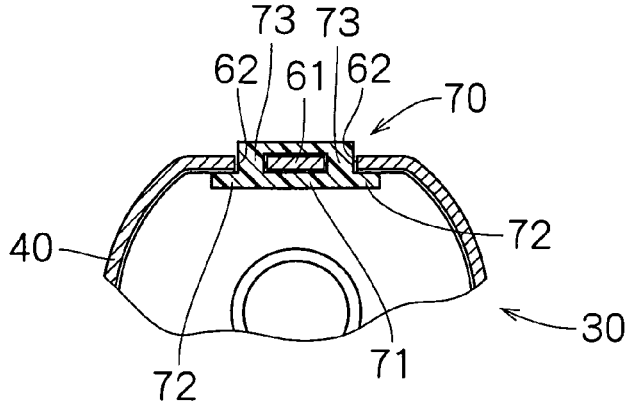
FIG. 4A is a cross-sectional view corresponding to FIG. 3B according to the second embodiment of the invention.
Figure 4B:
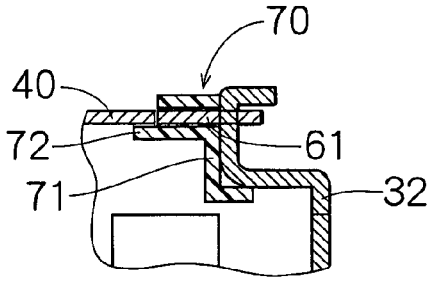
FIG. 4B is a cross-sectional view corresponding to FIG. 3C according to the second embodiment.
Figure 5A:
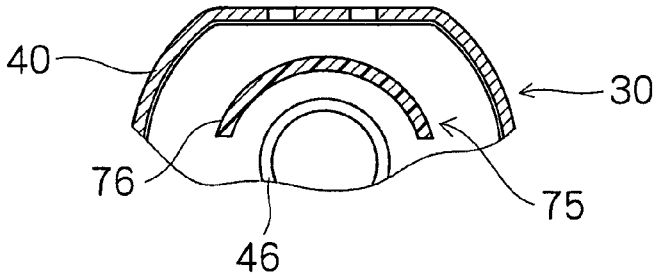
FIG. 5A is a cross-sectional view corresponding to FIG. 3B according to a third embodiment of the present invention.
Figure 5B:
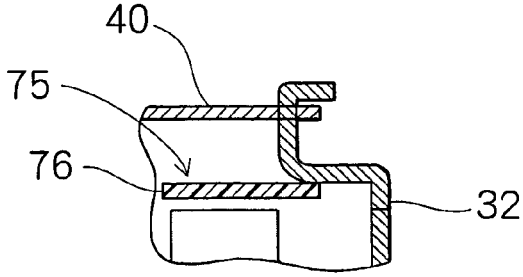
FIG. 5B is a cross-sectional view corresponding to FIG. 3C according to the third embodiment.
Figure 6A:
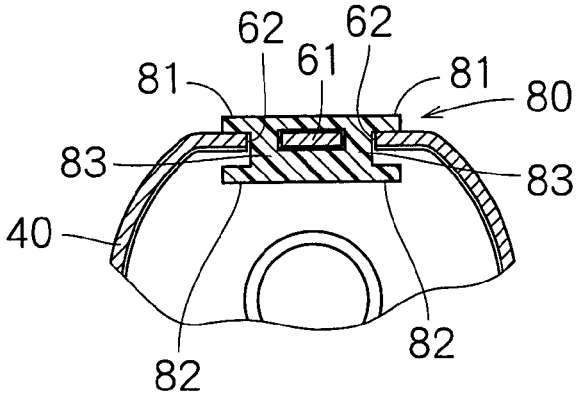
FIG. 6A is a cross-sectional view corresponding to FIG. 3B according to a fourth embodiment of the present invention.
Figure 6B:
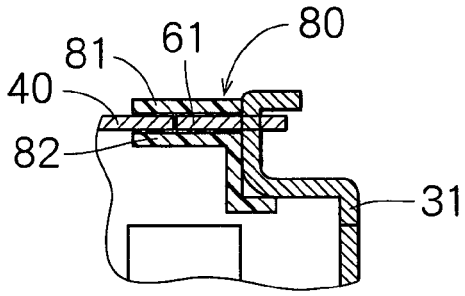
FIG. 6B is a cross-sectional view corresponding to FIG. 3C according to the fourth embodiment of the present invention.

FIGS. 4, 5, and 6 show throttle devices according to second, third, and fourth embodiments of the present invention, respectively. The same reference numerals as in the first embodiment are given to components substantially identical thereto, and the descriptions thereof is omitted.

Referring to FIG. 4, in the motor 30 of the throttle device 1 according to the second embodiment, the shape of the brush holder 70 is different from that of the first embodiment. In the second embodiment, a second shielding portion 72 integral with the base portion 71 is formed in the brush holder 70. The plate-shaped second shielding portion 72 covers a part of the inner periphery of the yoke 40, on the throttle gear 21 side of the slidable contact portion 46, between the commutator 44 and the brush 45. The second shielding portion 72 extends in a circumferential direction and an axial direction of the yoke 40 from the edge of the base portion 71.

Accordingly, besides the groove 62, a gap left between the groove 62 and the arm portion 73 is covered with the second shielding portion 72. Covering the groove 62 and the gap around it with the second shielding portion 72 creates a space between the yoke 40 and the brush holder 70, which is actually a complex shape like a labyrinth. The side of the slidable contact portion 46 facing the throttle gear 21 is shielded by the second shielding portion 72 which is integral with the brush holder 70, in the inside of the yoke 40. Therefore, the foreign compound, generated in the engagement portion of the throttle gear 21 and the reduction gear 22 and falling onto the motor 30, does not move toward the slidable contact portion 46 due to the second shielding portion 72.

As shown in FIG. 5, in the motor 30 of the throttle device 1 according to the third embodiment, the shape of a brush holder 75 is different from that of the second embodiment. In the third embodiment, a second shielding portion 76 provided in the brush holder 75 covers the upper half of the slidable contact portion 46, in other words, the side of the slidable contact portion 46 facing the throttle gear 21. The side of the slidable contact portion 46 facing the throttle gear 21 is shielded by the second shielding portion 76, which is integral with the brush holder 75, in the inside of the yoke 40. Accordingly, the second shielding portion 46 prevents the foreign compound, generated in the engagement portion of the throttle gear 21 and the reduction gear 22, and falling down onto the motor 30, from moving toward the slidable contact portion 46.

Referring to FIG. 6, in the motor 30 of the throttle device 1 according to the fourth embodiment, the shape of a brush holder 80 is different from those of the first and second embodiments. The fourth embodiment is the combination of the first and second embodiments. A first shielding portion 81 and a second shielding portion 82 are integrally formed in the brush holder 80. Besides the groove 62, a gap left between the groove 62 and an arm portion 83 is covered with the first and second shielding portions 81, 82. Covering the groove 62 and the gap around it with the first and second shielding portions 81, 82 makes a space between the yoke 40 and the brush holder 70 a complex shape, such as a labyrinth. The side of the slidable contact portion 46 facing the throttle gear 21 is shielded at both locations, outside and inside the yoke 40. Therefore, the first and the second shielding portions 81, 82 prevent the foreign compound, generated in the engagement portion of the throttle gear 21 and the reduction gear 22 and falling down onto the motor 30, from moving toward the slidable contact portion 46.

(Fifth Embodiment)

Figure 7:
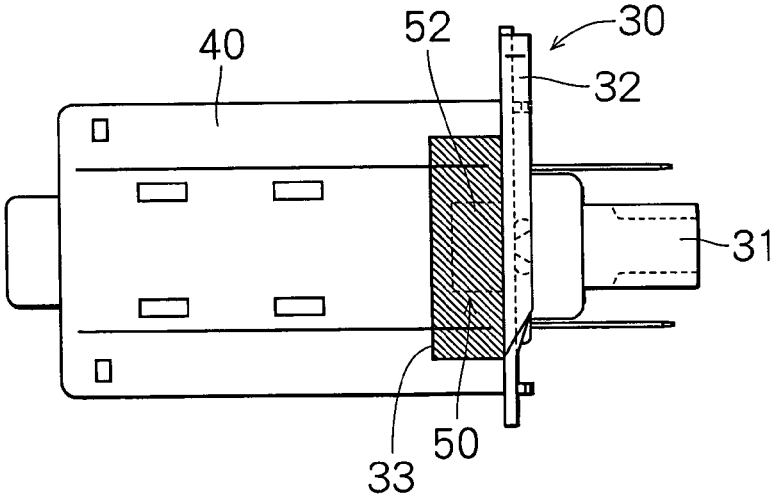
FIG. 7 is a schematic view of the motor of a throttle device, viewed from a throttle gear side, according to a fifth embodiment of the present invention.

FIG. 7 shows a throttle device according to a fifth embodiment of the present invention. The same reference numerals as in the first embodiment are given to components substantially identical, and the descriptions thereof are omitted.

In the motor 30 of the throttle device 1 according to the fifth embodiment of the present invention, as shown in FIG. 7, a tape member 33 is stuck on the outer periphery of the protruding portion 52 of the brush holder 50. The tape member 33 is, for example, an adhesive material such as that applied to a plastic resin tape. Since the tape member 33 is applied to the outer periphery of the protruding portion 52, the groove 62 and the gap left around it are covered with the tape member 33, even in a case in which the shielding portion, as described in the above first to fourth embodiments, is not provided to the brush holder 50. Accordingly, the tape member 33 shields the side of the slidable contact portion 46 facing the throttle gear 21 at the outside of the yoke 40. The tape member 33 prevents the foreign compound, which is generated in the engagement portion of the throttle gear 21 and the reduction gear 22, and which falls down onto the motor 30, from moving toward the slidable contact portion 46.

In the first to fifth embodiments described above, the gap left between the brush holder and the yoke is covered with the first shielding portion, the second shielding portion, or the tape member. The gap left between the brush holder and the yoke may be sealed with resin, which is placed into and fills the gap.

(Sixth Embodiment)

Figure 8:
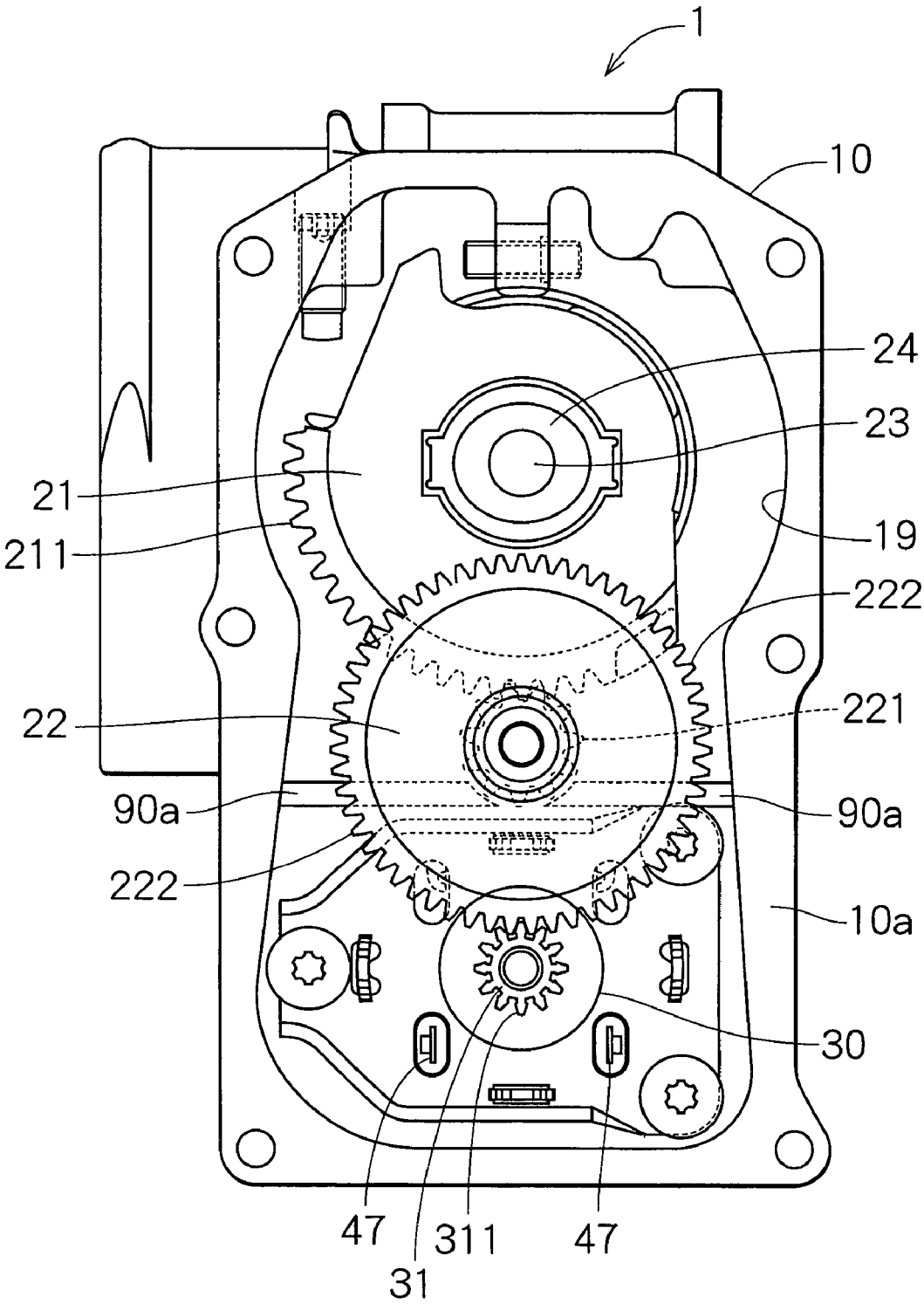
FIG. 8 is a side view of the throttle device, viewed from the direction of the arrow II of FIG. 1, according to a sixth embodiment of the present invention.

FIG. 8 shows a throttle device according to a sixth embodiment of the present invention. The same reference numerals as in the first embodiment are given to components substantially identical, therefore their descriptions are omitted.

In the throttle device 1 according to the sixth embodiment of the present invention, as shown in FIG. 8, a shielding plate 90*a*, as a third shielding portion, is provided in the throttle body 10. The shielding plate 90*a* is formed between the motor 30, and the engagement portion of the throttle gear 21 and the reduction gear 22, in the gear housing chamber 19 formed between the throttle body 10 and the cover 18. The shielding plate 90*a* is disposed in the vicinity of the engagement portion of the throttle gear 21 and the reduction gear 22, in the side of the motor 30 facing the throttle gear 21.

In this embodiment, the shielding plate 90*a* extends from the outer wall 10*a* of the throttle body 10 to the vicinity of the central axis of the reduction gear 22. The foreign compound like the abrasion powder, generated in the engagement portion of the throttle gear 21 and the reduction gear 22, falls onto the motor 30 side with the rotation of the reduction gear 22. The foreign compound falls onto the shielding plate 90*a* and accumulates thereon, because the shielding plate 90*a* is disposed between the motor 30 and the engagement portion of the throttle gear 21 and the reduction gear 22. Accordingly, the shielding portion 90*a* which shields the throttle gear 21 side of the slidable contact portion 46 prevents the foreign compound from falling onto the motor 30. Therefore, it is possible to prevent malfunctioning of the motor 30 due to the deposition of the foreign compound on the slidable contact portion 46.

The embodiments described above are individually applied to the throttle device. Embodiment combinations, however, may be applied to the throttle device. The combination of one of the first to fifth embodiments and the sixth embodiment, for example, may be applied to the throttle device.

What is claimed is:

1. A throttle device comprising:

a throttle body defining an intake air path;

a valve member being rotatable for adjusting an amount of intake airflow flowing in the intake air path;

a motor including:

a yoke;

a cap;

a brush holder fitted to a receptacle defined in the yoke;

a brush held by the brush holder; and a commutator in slidable contact with the brush at a sliding contact portion, wherein the motor generates torque to drive the valve member;

driving force transmission means having a plurality of gears, the driving force transmission means transmitting the torque generated in the motor to the valve member; and shielding means provided on a driving force transmission means side of the slidable contact portion, said shielding means extending laterally beyond a periphery of said receptacle for shielding the slidable contact portion.

2. The throttle device according to claim 1, wherein the shielding means is mounted to the yoke of the motor.

3. The throttle device according to claim 2, wherein the shielding means has a shielding portion disposed adjacent an outer surface of the yoke of the motor.

4. The throttle device according to claim 2, wherein the shielding means includes a shielding portion disposed adjacent an inner surface of the yoke of the motor.

5. The throttle device according to claim 1, wherein the shielding means is incorporated in the brush holder for holding the brush, and the shielding means has a shielding portion for shielding the slidable contact portion at the outside of the motor.

6. The throttle device according to claim 1, wherein the shielding means is incorporated in the brush holder for holding the brush, and the shielding means has a shielding portion for shielding the slidable contact portion at the inside of the motor.

7. The throttle device according to claim 1, wherein the shielding means comprises a tape member stuck on the motor, for covering the brush holder for holding the brush.

8. The throttle device according to claim 7, wherein said tape member shields the side of the slidable contact portion facing the throttle gear at the outside of the yoke.

9. The throttle device according to claim 1, wherein the shielding means is provided in a transmission means housing chamber for housing the driving force transmission means.

10. The throttle device according to claim 9, wherein the shielding means has a shielding portion disposed between an engagement portion of the gears of the driving force transmission means and the motor.

11. The throttle device according to claim 1, wherein the motor is disposed at a lower side of at least one of the plurality of gears.

12. The throttle device according to claim 1, wherein said shielding means is integral with the brush holder and disposed inside of the yoke.

13. The throttle device according to claim 1, wherein said shielding means includes an arched shielding portion.

14. The throttle device according to claim 1, wherein said shielding means includes first and second shielding portions, said first shielding portion being disposed outside said yoke and said second shielding portion being disposed inside said yoke.

15. The throttle device according to claim 14, wherein said first shielding portion and said second shielding portion are integrally formed with the brush holder.

16. The throttle device according to claim 1, wherein there is a clearance in a circumferential direction between at least a portion of the brush holder fitted to the receptacle and the yoke, and wherein the shielding means overlies said clearance to shield the same.

17. The throttle device according to claim 1, wherein the brush holder is held between the yoke and the cap.

* * * * *